US010087771B2

(12) United States Patent
Mcgarrah

(10) Patent No.: US 10,087,771 B2
(45) Date of Patent: Oct. 2, 2018

(54) GAS TURBINE ENGINE SEAL ASSEMBLY

(71) Applicant: United Technologies Corporation, Hartford, CT (US)

(72) Inventor: Craig R. Mcgarrah, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 469 days.

(21) Appl. No.: 14/769,031

(22) PCT Filed: Feb. 20, 2014

(86) PCT No.: PCT/US2014/017386
§ 371 (c)(1),
(2) Date: Aug. 19, 2015

(87) PCT Pub. No.: WO2015/002673
PCT Pub. Date: Jan. 8, 2015

(65) Prior Publication Data

US 2016/0003080 A1 Jan. 7, 2016

Related U.S. Application Data

(60) Provisional application No. 61/767,009, filed on Feb. 20, 2013.

(51) Int. Cl.

| | |
|---|---|
| ***F01D 11/08*** | (2006.01) |
| ***F01D 11/00*** | (2006.01) |
| ***F04D 29/52*** | (2006.01) |
| ***F04D 29/66*** | (2006.01) |

(52) U.S. Cl.
CPC ..... *F01D 11/08* (2013.01); *F01D 11/003* (2013.01); *F01D 11/005* (2013.01); *F04D 29/526* (2013.01); *F04D 29/668* (2013.01); *F05D 2240/11* (2013.01); *F05D 2250/75* (2013.01)

(58) Field of Classification Search
CPC .... F01D 11/08; F01D 11/005; F05D 2240/11; F05D 2250/75; F16J 15/0887; Y10T 29/49297
See application file for complete search history.

(56) References Cited

U.S. PATENT DOCUMENTS 2,701,155 A * 2/1955 Estel, Jr. ..... F16J 15/3236 267/163
4,603,892 A * 8/1986 Abbes ..... F16J 15/0893 277/614
4,759,555 A * 7/1988 Hailing ..... F16J 9/18 277/631
4,854,600 A * 8/1989 Hailing ..... F16J 15/021 277/626

(Continued)

*Primary Examiner* — Mark Laurenzi
*Assistant Examiner* — Shafiq Mian
(74) *Attorney, Agent, or Firm* — O'Shea Getz P.C.

(57) ABSTRACT

A seal assembly is positioned within a cavity that extends circumferentially about an axial centerline of a gas turbine engine. The cavity includes a cavity wall. The seal assembly includes a seal and a seal protector. The seal extends circumferentially within the cavity. The seal protector extends circumferentially within the cavity. The seal protector is positioned between the seal and the cavity wall. The seal protector includes a locating feature that is operative to contact the seal to aid in axially positioning the seal protector relative to the seal.

12 Claims, 4 Drawing Sheets

(56) References Cited

U.S. PATENT DOCUMENTS

| | | | | |
|---|---|---|---|---|
| 6,076,835 | A | 6/2000 | Ress et al. | |
| 6,199,871 | B1 * | 3/2001 | Lampes | F16J 15/0887 277/614 |
| 6,402,466 | B1 * | 6/2002 | Burdgick | F01D 9/04 277/630 |
| 7,128,323 | B2 * | 10/2006 | Iguchi | F16J 15/0887 277/644 |
| 7,789,619 | B2 * | 9/2010 | Durand | F01D 11/122 415/173.1 |
| 2005/0057003 | A1 * | 3/2005 | Iguchi | F16J 15/0887 277/591 |
| 2005/0118016 | A1 * | 6/2005 | Fokine | F01D 11/005 415/175 |
| 2006/0083607 | A1 * | 4/2006 | Synnott | F01D 11/08 415/173.1 |
| 2007/0231127 | A1 * | 10/2007 | Durand | F01D 11/122 415/173.1 |
| 2010/0044972 | A1 * | 2/2010 | Vila | F16J 15/3212 277/612 |
| 2012/0319362 | A1 | 12/2012 | Tholen et al. | |

* cited by examiner

GAS TURBINE ENGINE SEAL ASSEMBLY

This application claims priority to PCT Patent Appln. No. PCT/US14/17386 filed Feb. 20, 2014, which claims priority to U.S. Patent Appln. No. 61/767,009 filed Feb. 20, 2013.

BACKGROUND

1. Technical Field

Aspects of the present invention generally relate to gas turbine engines, and more particularly relate to gas turbine engine seal assemblies.

2. Background Information

Some gas turbine engines include a seal (e.g., a w-shaped seal) positioned within a cavity of the engine. The seal includes a contact surface. The seal may be susceptible to degradation over time, particularly proximate the contact surface. Eventually, the degradation can cause the seal to fracture, which can compromise the performance of the gas turbine engine. Aspects of the present invention are directed to this and other problems.

SUMMARY

According to one aspect of the present invention, a seal assembly that is positioned within a cavity that extends circumferentially about an axial centerline of a gas turbine engine is provided. The cavity includes a cavity wall. The seal assembly includes a seal and a seal protector. The seal and the seal protector each extend circumferentially within the cavity. The seal protector is positioned between the seal and the cavity wall. The seal protector includes a locating feature that is operative to contact the seal to aid in axially positioning the seal protector relative to the seal.

According to one aspect of the present invention, a seal protector for use in a gas turbine engine is provided. The seal protector is at least substantially annularly-shaped, the seal protector includes a radially-extending locating feature that is operative to contact a seal to aid in axially positioning the seal protector relative to the seal.

These and other features and advantages of the present invention will become apparent in light of the drawings and detailed description provided below.

DETAILED DESCRIPTION

Figure 1:
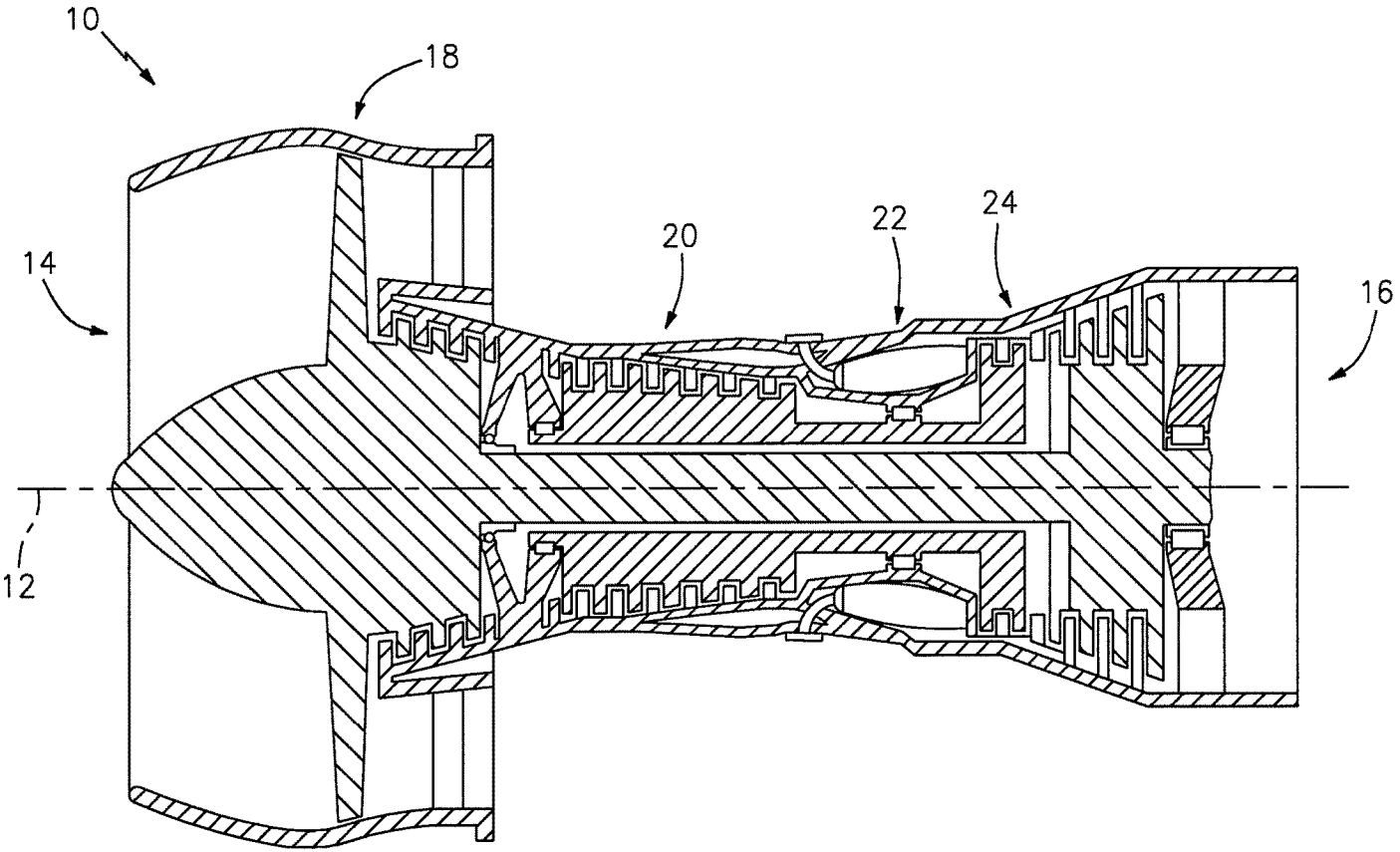
FIG. 1 is a sectional view of a gas turbine engine.

The present disclosure describes embodiments of a gas turbine engine 10, and components and systems thereof. Referring to the embodiment illustrated in FIG. 1, the engine 10 extends along an axial centerline 12 between a forward inlet section 14 and an aft exhaust section 16. The engine 10 includes a fan section 18, a compressor section 20, a combustor section 22, and a turbine section 24 positioned sequentially within the engine 10. In some embodiments, the engine 10 may additionally include an augmentor section (not shown). Aspects of the present invention are not limited to use with the engine 10 embodiment illustrated in FIG. 1. For example, although the engine 10 embodiment in FIG. 1 is depicted as being a non-augmented, high-bypass turbofan, aspects of the present invention may also be applied to other types of gas turbine engines, including augmented turbofans, low-bypass turbofans, etc.

Figure 2:
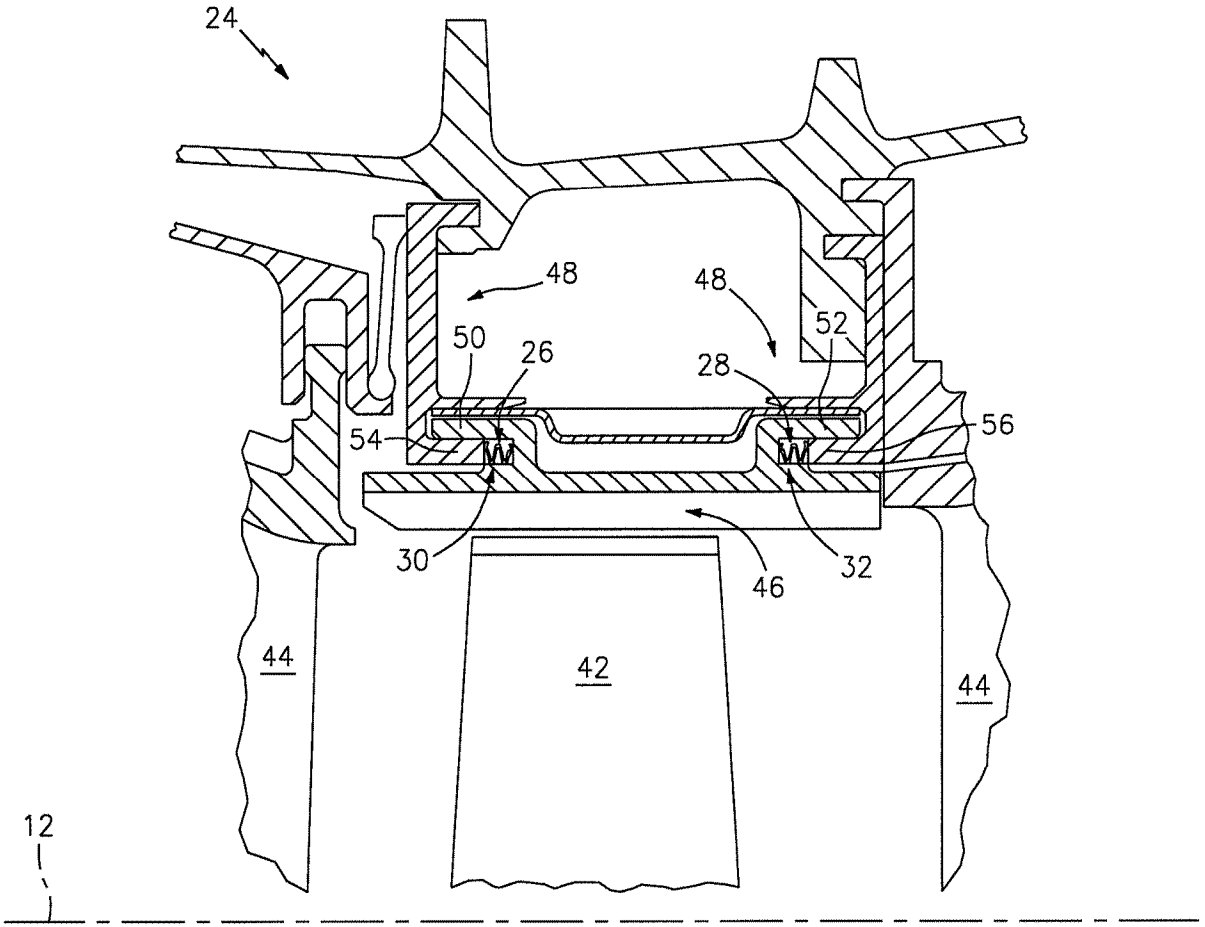
FIG. 2 is a sectional view of the turbine section of the engine of FIG. 1.

Referring to FIG. 2, the engine 10 also includes one or more seal assemblies 26, 28. For the sake of brevity, only the seal assemblies 26, 28 illustrated in FIG. 2 are described in detail. It should be appreciated, however, that other seal assemblies, which may be the same as or different from the seal assemblies 26, 28 illustrated in FIG. 2, may be located throughout the engine 10.

Figure 3:
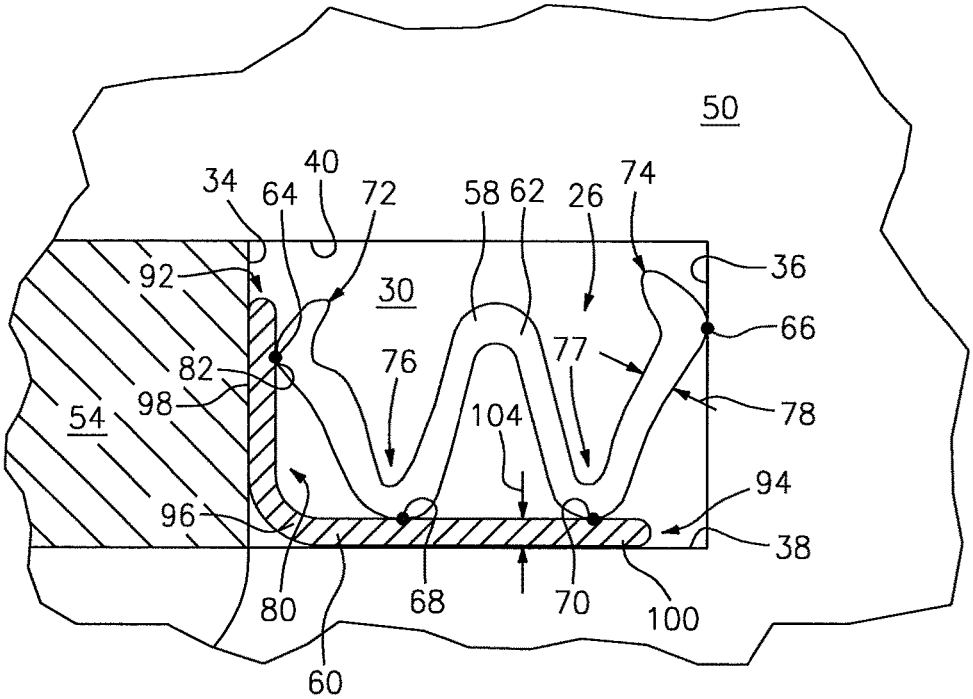
FIG. 3 is an enlarged sectional view of the seal assembly of FIG. 2.
Figure 4:
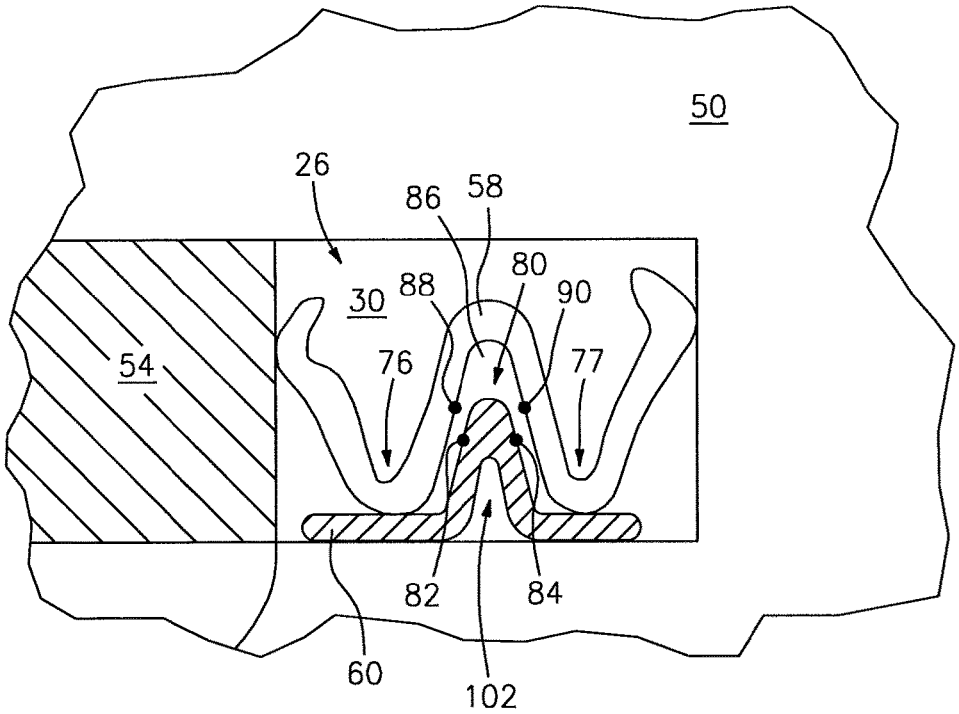
FIG. 4 is an sectional view of an alternative seal assembly.

Referring to FIG. 2-4, the seal assemblies 26, 28 are positioned within one or more cavities 30, 32 that extend circumferentially about the centerline 12 of the engine 10 (see FIG. 2). The term "circumferential", and variations thereof, should not be interpreted restrictively as relating to the perimeter of a circle; rather, the terms are used herein to refer to a direction around the centerline 12 of the engine 10. The cavities 30, 32 includes one or more cavity walls 34, 36, 38, 40 (see FIG. 3) that are formed by one or more components of the engine 10. The cavity walls 34, 36, 38, 40 need not be formed by any particular components of the engine 10. The components of the engine 10 that form the cavity walls 34, 36, 38, 40 may be unitary pieces or a plurality of segmented (e.g., circumferentially segmented) pieces that can be combined to form the cavity walls 34, 36, 38, 40. In the embodiment illustrated in FIG. 2, a forward cavity 30 and an aft cavity 32 each extend circumferentially about the centerline 12 of the engine 10 through the turbine section 24 of the engine 10. The turbine section 24 includes alternating rows of blades 42 and vanes 44, a blade outer air seal (BOAS) 46, and a blade outer air seal (BOAS) support 48. The BOAS 46 has hooks 50, 52, and the BOAS support 48 has cooperating hooks 54, 56. The BOAS hooks 50, 52 mate with the respective BOAS support hooks 54, 56 to form the forward cavity 30 and the aft cavity 32. Referring to FIG. 3, the forward cavity 30 includes a forward cavity wall 34, an aft cavity wall 36, a radially inner cavity wall 38, and a radially outer cavity wall 40. The term "radial", and variations thereof, are used herein to refer to movement or positioning in a direction perpendicular to the centerline 12 of the engine 10. The forward side cavity wall 34 is formed by the BOAS support hook 54, and the aft cavity wall 36, the radially inner cavity wall 38, and the radially outer cavity wall 40 are formed by the BOAS support hook 50.

Referring to FIGS. 3 and 4, the seal assemblies 26, 28 each include a seal 58 and a seal protector 60.

Referring to FIG. 3, the seal 58 extends circumferentially within the cavity 30, 32. In some embodiments, the seal 58 may be annularly-shaped or substantially annularly-shaped; e.g., the seal 58 may form an annular ring, a substantially annular split ring, etc. The seal 58 may be a unitary piece or a plurality of segmented (e.g., circumferentially segmented) pieces that can be combined to form the seal 58. The seal 58 includes at least two sealing contact surfaces 64, 66 and one or more positioning contact surfaces 68, 70. The sealing contact surfaces 64, 66 of the seal 58 each contact a cavity wall 34, 36, 38, 40 and/or the seal protector 60 and collectively provide a fluid seal between two adjacent regions of the engine 10. Each of the positioning contact surfaces 68, 70 of the seal 58 are operative to contact a cavity wall 34, 36, 38, 40 and/or the seal protector 60 to aid in positioning the seal 58 within the cavity 30, 32. In the embodiment illustrated in FIG. 3, for example, the seal 58 includes a forward sealing contact surface 64, an aft sealing contact surface 66, a forward positioning contact surface 68, and an aft positioning contact surface 70. In the embodiment illustrated in FIG. 3, the sealing contact surfaces 64, 66 provide a fluid seal between a first region of the engine 10 radially inboard of the BOAS 46 and a second region of the engine 10 radially outboard of the BOAS 46.

The seal 58 need not have any particular geometry. In some embodiments, the seal 58 may extend generally axially between a first end 72 and a second end 74. In the embodiment illustrated in FIG. 3, for example, the seal 58 extends generally axially between a first end 72 positioned proximate the forward cavity wall 34, and a second end 74 positioned proximate the aft cavity wall 36. In some embodiments, the seal 58 may include one or more bellows 76, 77, which may be included, for example, to improve the flexibility of the seal 58. In the embodiment illustrated in FIG. 3, the seal 58 includes a forward bellow 76 and an aft bellow 77. In the embodiment illustrated in FIG. 3, the seal 58 is generally W-shaped. In other embodiments, the seal 58 may have other undulating (e.g., serpentine) geometries; e.g., the seal 58 may be M-shaped, V-shaped, etc. The seal 58 has a thickness 78. The thickness 78 may preferably be approximately two hundred fifty (250) micrometers. In the embodiment illustrated in FIG. 3, the thickness 78 is substantially uniform. In other embodiments, the thickness 78 may not be substantially uniform.

The seal 58 need not be made of any particular material or combination of materials. The material or combination of materials of the seal 58 may be selected so that the seal 58 is both strong and capable of withstanding high temperatures. In some embodiments, the seal 58 may be made from a cobalt alloy. Examples of acceptable cobalt alloys include: Haynes® 188 Alloy, manufactured by Haynes International, Inc., Kokomo, Ind., U.S.A. ("Haynes"); and Stellite® Alloy, manufactured by Deloro Stellite Group, Goshen, Ind., U.S.A. In some embodiments, the seal 58 may be made from a nickel alloy. Examples of acceptable nickel alloys include: Inconel® 625 Alloy, manufactured by Special Metals Corporation, New Hartford, N.Y., U.S.A. ("SMC"); Inconel® 718 Alloy, manufactured by SMC; Inconel® X-750 Alloy, manufactured by SMC; and Waspaloy® Alloy, manufactured by United Technologies Corporation, Hartford, Conn., U.S.A. The seal 58 need not be uniform in material. For example, portions of the seal 58 proximate the sealing contact surfaces 64, 66 and/or the positioning contact surfaces 68, 70 may be made from a material or combination of materials that differ from other portions of the seal 58.

Referring still to FIG. 3, the seal protector 60 extends circumferentially within the cavity 30, 32. In some embodiments, the seal protector 60 may be annularly-shaped or substantially annularly-shaped; e.g., the seal protector 60 may form an annular ring, a substantially annular split ring, etc. The seal protector 60 may be a unitary piece or a plurality of segmented (e.g., circumferentially segmented) pieces that can be combined to form the seal protector 60. In some embodiments, the seal protector 60 may extend between a first end and a second end. In the embodiment illustrated in FIG. 3, for example, the seal protector 60 extends between a first end 92 proximate the forward cavity wall 34, and a second end 94 proximate the radially inner cavity wall 38. In some embodiments, the seal protector 60 may include a bent portion 96. In the embodiment illustrated in FIG. 3, for example, the seal protector 60 includes a first body portion 98, a second body portion 100, and a bent portion 96 extending in a direction between the first and second body portions 98, 100. In some embodiments, the seal protector 60 may include a bellow 102, which may be included, for example, to improve the flexibility of the seal protector 60. In the embodiment illustrated in FIG. 4, for example, the seal protector 60 includes a bellow 102. Referring to FIG. 3, the seal protector 60 has a thickness 104. The thickness 104 may preferably be approximately two hundred fifty (250) micrometers. In the embodiment illustrated in FIG. 3, the thickness 104 is substantially uniform. In other embodiments, the thickness 104 may not be substantially uniform.

The seal protector 60 is positioned relative to the seal 58 such that the seal protector 60 is between a positioning contact surface 68, 70 of the seal 58 and a cavity wall 34, 36, 38, 40. In the embodiment illustrated in FIG. 3, for example, the seal protector 60 is between the forward and aft positioning contact surfaces 68, 70 of the seal 58 and the radially inner cavity wall 38.

The seal protector 60 includes a radially-extending locating feature 80. The locating feature 80 includes one or more locating surfaces 82, 84 that are operative to contact the seal 58 to aid in axially positioning the seal protector 60 relative to the seal 58. In some embodiments, the locating feature 80 is positioned between a sealing contact surface 64, 66 of the seal 58 and a cavity wall 34, 36, 38, 40. In the embodiment illustrated in FIG. 3, for example, the locating feature 80 is formed by the radially-extending first body portion 98 of the seal protector 60, and is positioned between the forward sealing contact surface 64 of the seal 58 and the forward cavity wall 34. The locating surface 82 of the locating feature 80 contacts the forward sealing contact surface 64 of the seal 58 to aid in axially positioning the seal protector 60 relative to the seal 58. In some embodiments, the locating feature 80 may be positioned at least partially within a radially-extending recess 86 formed by the seal 58. In the embodiment illustrated in FIG. 4, for example, the locating feature 80 is formed by the radially-extending bellow 102 of the seal protector 60, and it is positioned within the radially-extending recess 86 formed between the forward and aft bellows 76, 77 of the seal 58. The locating feature 80 includes a forward locating surface 82 and an aft locating surface 84. The forward locating surface 82 is operative to contact a forward recess surface 88 of the seal 58 to aid in axially positioning the seal protector 60 relative to the seal 58, and the aft locating surface 90 is operative to contact an aft recess surface 90 of the seal 58 to aid in axially positioning the seal protector 60 relative to the seal 58.

The seal protector 60 need not be made of any particular material or combination of materials. The material(s) used to make the seal protector 60 may be the same as or different than the material(s) used to make the seal 58. In some embodiments, the seal protector 60 may be made of a ceramic material. The seal protector 60 need not be uniform in material. For example, the portions of the seal protector 60 that form the locating feature 80 may be made from a material or combination of materials that differs from other portions of the seal protector 60.

During operation of the engine 10, ambient air enters the fan section 18 and is directed first into the compressor section 20, where the pressure of the ambient air is increased to form compressed air. The compressed air is delivered to the combustor section 22, mixed with fuel, and burned to produce high energy working gases. Within the turbine section 24, working gases are expanded as they pass along alternating rows of blades 42 and vanes 44. The expansion of working gases produces power for the turbine section 24, as well as usable work, such as thrust for an aircraft.

During operation of the engine 10, the seal assemblies 26, 28 provide a fluid seal between two adjacent regions of the engine 10. The seal assemblies 26, 28 may experience mechanical stress caused, for example, by a temperature gradient and/or a pressure gradient across the seal assemblies 26, 28. If the seal protector 60 was not included in each seal assembly 26, 28, each of the positioning contact surfaces 68, 70 of the seal 58 would contact a cavity wall 34, 36, 38, 40. This could be problematic, for example, because the positioning contact surfaces 68, 70 may be particularly susceptible to degradation or fracture if allowed to contact the cavity walls 34, 36, 38, 40 during times of mechanical stress. To prevent degradation or fracture of the seal 58, the seal protector 60 is positioned between the seal 58 and the cavity walls 34, 36, 38, 40, as described above. The seal protector 60 may act as a sacrificial component of the engine 10, experiencing degradation or fracture that might otherwise be experienced by the seal 58. During operation of the engine 10, one or more locating surfaces 82, 84 of the locating feature 80 may contact the seal 58 to prevent or limit undesirable axial movement of the seal protector 60 relative to the seal 58.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A seal assembly positioned within a cavity that extends circumferentially about an axial centerline of a gas turbine engine, which cavity includes a cavity wall, which seal assembly comprises:

a seal that extends circumferentially within the cavity; and a seal protector that extends circumferentially within the cavity, which seal protector is positioned between the seal and the cavity wall, and which seal protector includes a radially-extending locating feature that is operative to contact the seal to aid in axially positioning the seal protector relative to the seal;

wherein the cavity includes a forward cavity wall, an aft cavity wall, a radially inner cavity wall, and a radially outer cavity wall, and wherein the seal protector is positioned between a positioning contact surface of the seal and the radially inner cavity wall; and wherein the locating feature is positioned between an aft sealing contact surface of the seal and the aft cavity wall.

2. The seal assembly of claim 1, wherein the seal is at least substantially annularly-shaped, and wherein the seal protector is at least substantially annularly-shaped.

3. The seal assembly of claim 2, wherein the seal forms a split ring, and wherein the seal protector forms a split ring.

4. The seal assembly of claim 1, wherein the seal protector includes a first body portion that extends between a first end of the seal protector and a bent portion of the seal protector, and a second body portion that extends between a second end and the bent portion of the seal protector, wherein the locating feature is formed by the first body portion of the seal protector.

5. The seal assembly of claim 1, wherein the seal is made from a material selected from the group consisting of: a cobalt alloy; a nickel alloy.

6. The seal assembly of claim 1, wherein the seal protector is made from a material selected from the group consisting of: a cobalt alloy; a nickel alloy; a ceramic.

7. A seal assembly positioned within a cavity that extends circumferentially about an axial centerline of a gas turbine engine, which cavity includes a cavity wall, which seal assembly comprises:

a seal that extends circumferentially within the cavity; and a seal protector that extends circumferentially within the cavity, which seal protector is positioned between the seal and the cavity wall, and which seal protector includes a radially-extending locating feature that is operative to contact the seal to aid in axially positioning the seal protector relative to the seal;

wherein the seal forms a radially extending recess, wherein the locating feature of the seal protector is positioned at least partially within the recess; and wherein the seal includes a first bellow and a second bellow, wherein the recess is formed between the first and second bellows.

8. The seal assembly of claim 7, wherein the seal comprises a cobalt alloy or a nickel alloy.

9. The seal assembly of claim 7, wherein the seal protector comprises a cobalt alloy, a nickel alloy or a ceramic.

10. A seal assembly positioned within a cavity that extends circumferentially about an axial centerline of a gas turbine engine, which cavity includes a cavity wall, which seal assembly comprises:

a seal that extends circumferentially within the cavity; and a seal protector that extends circumferentially within the cavity, which seal protector is positioned between the seal and the cavity wall, and which seal protector includes a radially-extending locating feature that is operative to contact the seal to aid in axially positioning the seal protector relative to the seal;

wherein the seal forms a radially extending recess, wherein the locating feature of the seal protector is positioned at least partially within the recess; and wherein the seal protector includes a bellow, and wherein the locating feature of the seal protector is formed by the bellow.

11. The seal assembly of claim 10, wherein the seal comprises a cobalt alloy or a nickel alloy.

12. The seal assembly of claim 10, wherein the seal protector comprises a cobalt alloy, a nickel alloy or a ceramic.

* * * * *